US009669956B2

(12) United States Patent
Busi et al.

(10) Patent No.: US 9,669,956 B2
(45) Date of Patent: Jun. 6, 2017

(54) DEVICE FOR FEEDING SELF-ADHESIVE OR "PRESSURE SENSITIVE" LABELS TO A LABELLING MACHINE

(75) Inventors: Roberto Busi, Virgilio (IT); Denis Cattabriga, Castiglione Delle Stiviere (IT); Giovanni Saccardi, Malavicina di Roverbella (IT); Alberto Zamboni, Verona (IT)

(73) Assignee: KOSME S.R.L. UNIPERSONALE, Roverbella (IT)

( * ) Notice: Subject to any disclaimer, the term of this patent is extended or adjusted under 35 U.S.C. 154(b) by 254 days.

(21) Appl. No.: 14/386,933

(22) PCT Filed: May 4, 2012

(86) PCT No.: PCT/IT2012/000130

§ 371 (c)(1),
(2), (4) Date: Sep. 22, 2014

(87) PCT Pub. No.: WO2013/164863

PCT Pub. Date: Nov. 7, 2013

(65) Prior Publication Data

US 2015/0083339 A1 Mar. 26, 2015

(51) Int. Cl.
*B65C 9/18* (2006.01)
*B65C 9/00* (2006.01)

(52) U.S. Cl.
CPC ..... *B65C 9/1865* (2013.01); *B65C 9/0006* (2013.01); *Y10T 156/17* (2015.01)

(58) Field of Classification Search
CPC ..... B65C 9/1865; B65C 9/0006; B65C 9/42; B65C 9/1869; Y10T 156/1776
(Continued)

(56) References Cited

U.S. PATENT DOCUMENTS 4,242,167 A 12/1980 Hoffmann
4,544,437 A * 10/1985 Gibson ..... B41F 13/0008 101/228
(Continued)

FOREIGN PATENT DOCUMENTS

EP 1619129 A1 1/2006
GB 2072135 9/1981
(Continued)

*Primary Examiner* — John Goff
(74) *Attorney, Agent, or Firm* — Pearne & Gordon LLP

(57) ABSTRACT

A device (1) for feeding self-adhesive or "pressure sensitive" labels to a labelling machine comprises a frame (2), supporting means (3) for a reel of a web with the labels attached to it, a station (5) for detaching the labels from the web, recovery means (6), return means (8), and means (10) for moving the web comprising: a motor-driven roller (11) and at least one unit (15) for pressing the web against the motor-driven roller (11) comprising at least one contact roller (16), mounted on a support (17), for clamping the web against the motor-driven roller (11). The support (17) being movable relative to the frame (2) between an operating position, with the contact roller (16) pressed against the motor-driven roller (11), and an insertion position, with the contact roller (16) distanced from the motor-driven roller (11). There being a switching element (18) associated with the support (17) which in their first configuration is in the operating position, in a second configuration is in an insertion position and in a third configuration is able to move between the insertion position and a maintenance position in which the contact roller (16) is further from the motor-driven roller (11) than in the insertion position.

17 Claims, 8 Drawing Sheets

(58) Field of Classification Search
USPC ..... 156/569, DIG. 33
See application file for complete search history.

(56) References Cited

U.S. PATENT DOCUMENTS

| | | | | |
|---|---|---|---|---|
| 2002/0096264 | A1 * | 7/2002 | Yang | B65C 3/14 156/556 |
| 2006/0102291 | A1 | 5/2006 | Hongo | |

FOREIGN PATENT DOCUMENTS

| | | | | |
|---|---|---|---|---|
| IT | WO 2010040395 | A1 * | 4/2010 | B65C 9/18 |
| IT | WO 2011018804 | A1 * | 2/2011 | B65C 9/1865 |
| JP | 2005280820 | A | 10/2005 | |

* cited by examiner

DEVICE FOR FEEDING SELF-ADHESIVE OR "PRESSURE SENSITIVE" LABELS TO A LABELLING MACHINE

This invention relates to a device for feeding self-adhesive or "pressure sensitive" labels to a labelling machine.

In particular it relates to those devices in which labels are moved while attached to a web that is wound to form a reel, supported by supporting means, which is then unwound. Of particular interest are those devices which use movement means and return elements to feed the labels attached to the web to a label detaching station, where the labels are detached from the web so that they can definitively leave the device and be passed on to a labelling machine which applies them, for example, on bottles. The web without labels is then recovered by recovery means so that, for example, it can be rewound to form a recovery reel, that is to say a reel of web without labels on it. An example of such a type of device is provided in patent application EP 1619129 by the same Applicant.

In more detail, reference is made to those devices in which the movement means comprise a motor-driven roller which allows the web to be moved using friction. In such devices, like those indicated in the above-mentioned patent application EP 1619129, there is at least one pressure unit which allows a contact roller to be pressed against the motor-driven roller for clamping the web between them: the contact roller, pressing against the motor-driven roller, guarantees contact between the web and the motor-driven roller. In similar devices, the contact roller is mounted on a support, in particular with a first side connected to a lower part of the support, and a second side connected to an upper part, with the axis of rotation substantially parallel with that of the motor-driven roller. The support is associated with the frame and is movable relative to it between an operating position in which the contact roller is pressed against the motor-driven roller and an insertion position in which the contact roller is slightly distanced from the motor-driven roller to allow insertion (and removal) of the web between them, for example during a reel change-over. The support may be shifted between the two positions by a switching element which is rotatable relative to the frame and is associated with the support. The motor-driven roller, pressure unit (with all of the components connected to it) and the switching element together form part of the movement means. The switching element is irremovably associated with the support by a connecting element, which is coupled to the lower part of the support. The connecting element usually has a coupling surface on which a groove is made which acts as a cavity and guide for a support locking pin, able to slide inside it. Rotation of the switching element, and therefore of the connecting element fixed to it, causes relative sliding of the locking pin and the groove. The latter is in turn cam-shaped so that during said sliding the locking pin shifts relative to the frame, causing the support to shift, in particular between the operating position and the insertion position, depending on the direction of rotation imparted to the switching element. In the case of patent application EP 1619129, in particular, the support has a first side rotatably associated with the frame and a second side supporting the locking pin at the lower part. The contact roller is mounted at an intermediate position between the first side and the second side. Shifting of the groove relative to the locking pin which slides in it, caused by rotation of the switching element, results in shifting of the second side of the support and therefore shifting of the contact roller between the operating position, in which as indicated the contact roller is pressed against the motor-driven roller, and the insertion position, in which the contact roller is distanced.

Usually, prior art devices such as that described in patent application EP 1619129 have two pressure units (both part of the movement means), which are located on opposite sides of the motor-driven roller. The two pressure units are substantially similar. Said devices allow the web to be moved along two lines in opposite directions. In particular, between a first pressure unit and the motor-driven roller the web with the labels is fed in a first direction of feed to the detaching station, where the labels are detached. The web without labels is then fed in a second direction, opposite to the first, between the second pressure unit and the motor-driven roller. In this way the same amount of web fed to the detaching station is simultaneously removed from it. In the presence of two pressure units, the switching element is associated with the support of each of them. In particular the connecting element is associated with the two supports (one for each pressure unit) and the coupling face has two grooves, one for each locking pin (one per support). Rotation of the connecting element causes simultaneous sliding between the locking pins and the respective seats and consequently simultaneous rotation of the second ends (which in passing from the insertion position to the operating position, move towards each other, and vice versa).

However, this prior art technology has several disadvantages.

In label feed devices which operate at significant operating speeds and practically continuously, the movement means often require routine maintenance both to clean them and for example after the web has jammed at the motor-driven roller, for action on the contact roller, or even for extraordinary maintenance, for example to the motor-driven roller requiring it to be removed from the related seat in the frame to work on it or parts of the device which are connected to it.

However, the prior art devices do not facilitate maintenance operations. When the worker must carry out maintenance operations other than simply substituting the web, he is forced to disassemble the movement means into the various components. For example, if a contact roller needs to be substituted, the worker must first remove the switching element from the frame, that is to say, unscrew it from the frame, lift it off the frame and release it from the support (or supports). When the maintenance is complete, the worker must then perform the procedures in reverse order, requiring effort and above wasting all time.

Moreover, with the prior art devices, even simple operations for cleaning the movement means are very complicated. In fact with the prior art devices cleaning operations are performed with the supports in the insertion position. However, in that position the space between the support and the motor-driven roller is decidedly reduced and does not allow easy access unless using relatively thin cleaning brushes or tools. Moreover, in the insertion position many zones inside the support remain inaccessible and dirt and dust can easily build up in such zones. Such cleaning operations are cursory and therefore, occasionally, the movement means must be disassembled, as described above, to carry out in-depth cleaning.

Moreover, in prior art devices, during high speed operation, there may be losses of adherence between the web and the motor-driven roller. In particular, the web may suddenly slip, sliding on the motor-driven roller instead of moving as one with it. Moreover, again in the case of web high speed feed, there may be vibrations in the support which can cause irritating noises.

In this context the technical purpose which forms the basis of this invention is to provide a device for feeding self-adhesive or "pressure sensitive" labels to a labelling machine which overcomes the above-mentioned disadvantages.

In particular, this invention has for a technical purpose to provide a device for feeding self-adhesive or "pressure sensitive" labels to a labelling machine which facilitates maintenance and cleaning operations, guaranteeing easy access to the components of which the movement means consist, reducing the times necessary compared with prior art devices.

It is also the technical purpose of this invention to provide a device for feeding self-adhesive or "pressure sensitive" labels to a labelling machine which allows vibrations and noise from operation to be limited.

The technical purpose specified and the aims indicated are substantially achieved by a device for feeding self-adhesive or "pressure sensitive" labels to a labelling machine as described in the appended claims.

Further features and the advantages of this invention are more apparent in the detailed description, with reference to the accompanying drawings which illustrate several preferred, non-limiting embodiments of a device for feeding self-adhesive or "pressure sensitive" labels to a labelling machine, in which.

Figure 2:
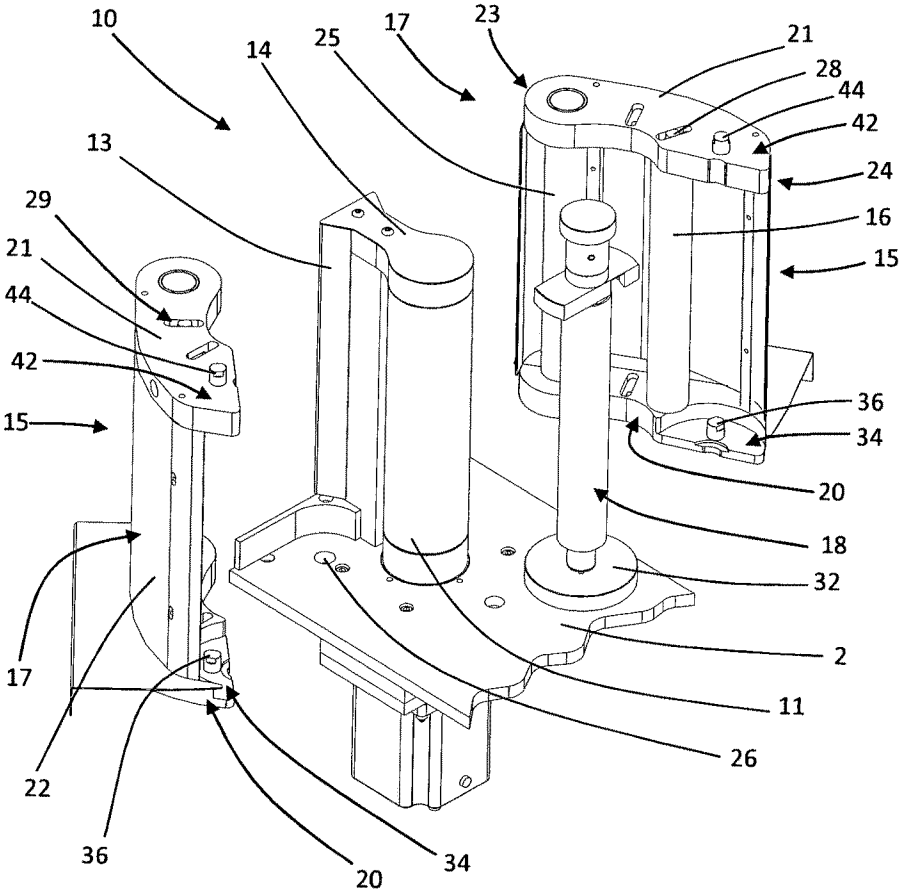
FIG. 2 is an axonometric exploded view of the movement means of the device of FIG. 1.

With reference to the accompanying drawings the numeral 1 denotes in its entirety a device for feeding self-adhesive or "pressure sensitive" labels to a labelling machine according to this invention.

The device 1 according to this invention comprises a frame 2 which can be coupled to a labelling machine and/or can be rested on the ground, for example by means of suitable supports (not illustrated). The frame 2 is in fact advantageously set up to allow the device 1 to be integrated in a labelling apparatus and in particular to allow device 1 connection and/or positioning close to a labelling machine.

The device 1 also comprises supporting means 3, mounted on the frame 2, for supporting a web reel, intended to be unwound during operation. In the known way, the reel is formed by winding a web over itself (or at least around a winding element), there being self-adhesive or "pressure sensitive" labels removably attached to the web. In the embodiment illustrated, the supporting means 3 comprise a supporting plate 4 on which the reel can be placed and reel positioning means for positioning the reel centrally relative to the supporting plate 4 and keeping it in position during unwinding.

The device 1 also comprises a station 5 for detaching the labels, associated with the frame 2 to allow the labels to be detached from the web. At the detaching station 5 the labels definitively leave the device 1 so that they can be passed on to a labelling machine.

Figure 1:
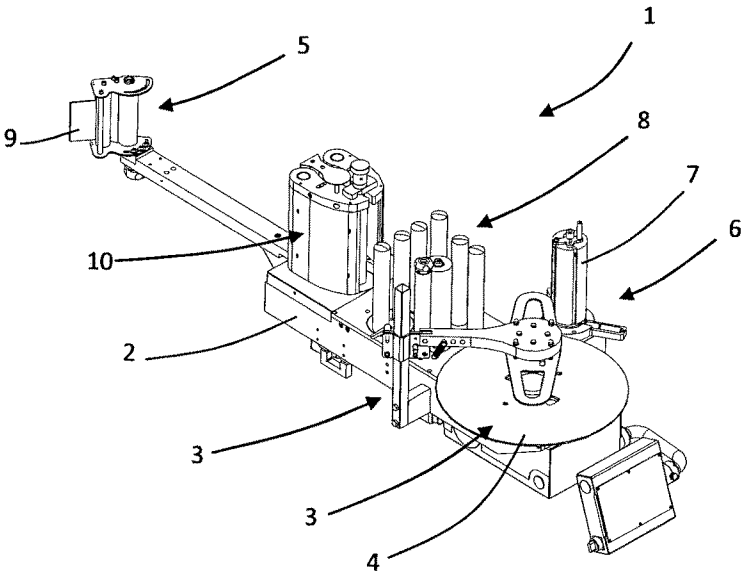
FIG. 1 is an axonometric top view of a device according to this invention.

The device 1 also comprises means 6 for recovering the web without labels, which are also associated with the frame 2. In the embodiment illustrated in FIG. 1 they comprise at least one rewinding roller 7 which allows the web without labels to be rewound to form a recovery reel.

Between the supporting means 3, the detaching station 5 and the recovery means 6 there is a web running path, along which web return means 8 are also positioned, the latter also associated with the frame 2, usually comprising rollers which are normally idle and/or tilting return elements, substantially of the known type.

Therefore, the web can run along the running path. As the reel is gradually unwound the web passes through the return means 8 until it arrives at the detaching station 5. At the detaching station 5 the web running path has a sudden change of direction caused, in the embodiment illustrated in FIG. 1, by a blade 9 (substantially in the known way). The change of direction, during web feeding, causes the label to be detached from the web. The web without labels then travels the rest of the running path, if necessary through other return elements advantageously until it reaches the recovery means 6 and in particular the rewinding roller 7.

Figure 13:
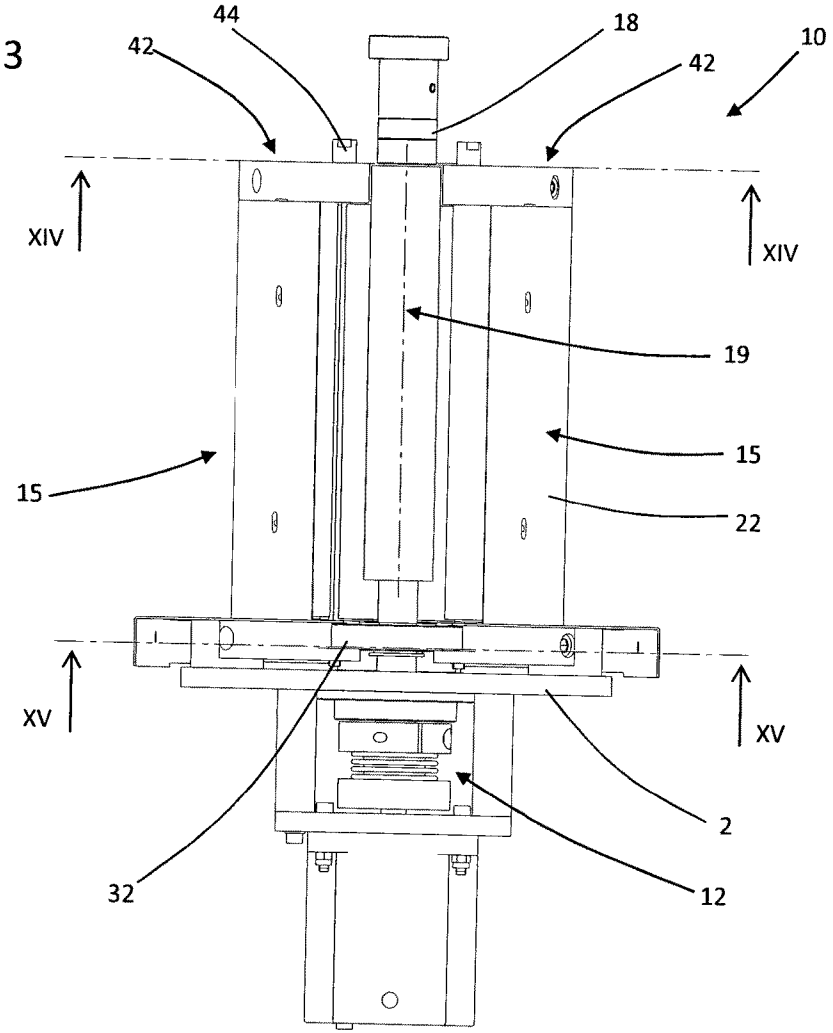
FIG. 13 is a front view of the movement means of FIG. 7.

The device 1 according to this invention also comprises means 10 for moving the web which are associated with the frame 2 for moving the web along the running path. The movement means 10 also guarantee, in the known way, web feeding to the detachment station 5 in a way that can be synchronised with the other parts that make up a labelling apparatus, and in particular with a labelling machine. In the embodiment illustrated, the movement means 10 are advantageously positioned along the running path. The movement means 10 in turn comprise a motor-driven roller 11 associated with the frame 2 and which can rotate about a first axis of rotation (not illustrated and perpendicular to the plane of FIGS. 15 to 18) for moving the web by contact with it. The motor-driven roller 11 (clearly visible in FIG. 2) is operatively connected to a rotation driving unit 12 (FIG. 13) which in the known way comprises a motor and a transmission connected between the motor and the motor-driven roller 11. In the embodiment illustrated the motor-driven roller 11 has one of its ends connected to the rotation driving unit 12 through a passage made in the frame 2, while the other end is rotatably connected to a connecting structure 13 associated with the frame 2. In particular, this other end is rotatably associated with a connector 14 positioned above the connecting structure 13. Moreover, in the embodiment illustrated, the direction of rotation imparted by the rotation driving unit 12 to the roller is such that it causes the web to be fed from the supporting means 3 towards the detaching station 5, therefore in the accompanying drawings the motor-driven roller 11 rotates in a clockwise direction (if seen from above).

As already indicated, the motor-driven roller 11 allows the web to be drawn by contact with it thanks to the adherence between the web and the lateral surface of the motor-driven roller 11.

To guarantee adherence, the movement means 10 comprise at least one pressure unit 15 for pressing the web against the motor-driven roller 11.

The pressure unit 15 in turn comprises at least one contact roller 16 which can rotate, about a second axis of rotation (not illustrated) parallel with the first axis of rotation, idly or with a slight braking action applied to it. At least during device 1 operation, the contact roller 16 is pressed against the motor-driven roller 11 and therefore can draw the web by rotating in the opposite direction to the motor-driven roller (therefore, in the accompanying drawings in an anti-clockwise direction, if seen from above). The contact roller 16 clamps the web between itself and the motor-driven roller 11. The pressure of the contact roller 16 against the motor-driven roller 11 allows an increase in the adherence between the web and the lateral surface of the motor-driven roller 11, increasing its drawing effectiveness, and thus preventing the web from slipping relative to the lateral surface of the motor-driven roller (substantially in the known way).

Advantageously, to increase the contact surface area between the web and the motor-driven roller 11, the pressure unit 15 (and in general both if there is an additional pressure unit 15 as described in more detail below) may comprise two or more contact rollers 16. Even more advantageously, the contact rollers 16 related to one pressure unit 15 may be positioned in such a way as to form a part of the running path, forcing the web to be partly wound around the motor-driven roller 11.

The pressure unit 15 comprises at least one support 17 for the contact roller 16, associated with the frame 2. Advantageously, in the presence of two or more contact rollers 16, they are also associated with the support 17. The support 17 is movable relative to the frame 2 between an operating position, in which the contact roller 16 is pressed against the motor-driven roller 11, and an insertion position in which the contact roller 16 is distanced from the motor-driven roller 11 and allows insertion of the web between them.

Figure 7:
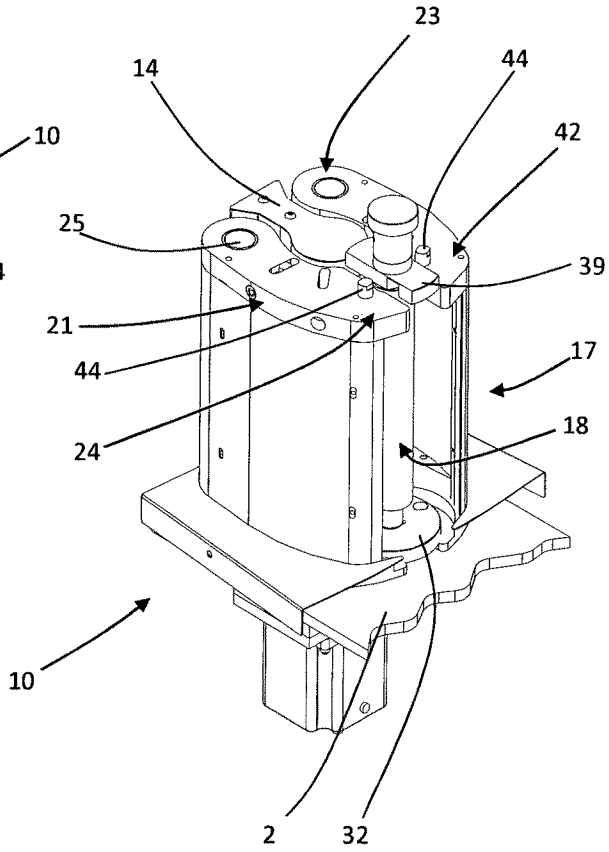
FIG. 7 shows the movement means of FIG. 6 in a second configuration.

The movement means 10 also comprise a switching element 18 associated with the support 17 for making the support 17 shift at least between the operating position and the insertion position. In particular the switching element 18 and the support 17 can adopt a first reciprocal configuration in which the switching element 18 keeps the support 17 in the operating position (FIG. 6) and a second reciprocal configuration in which the switching element 18 keeps the support 17 in the insertion position (FIG. 7). Advantageously, the switching element 18, as is described in more detail below, is rotatable about a third axis of rotation 19 (FIG. 13) parallel with the first axis of rotation, and its rotation causes the switching between the first configuration and the second configuration and the passage of the support 17 between the operating position and the insertion position.

In the preferred embodiment illustrated (FIG. 2) the support 17 comprises a lower part 20 and an upper part 21 which are advantageously substantially vertically aligned (that is to say, parallel with the first axis of rotation) and connected to each other by a covering 22 which acts as a safety guard during operation.

Also in the preferred embodiment, the support 17 advantageously comprises a first side 23 rotatably connected to the frame 2 and a free second side 24. In particular, on the first side 23 the support 17 pivots at the frame 2 and can be rotated about a fourth axis of rotation parallel with the first axis of rotation. In the embodiment illustrated, the support 17 pivots at the frame 2 by means of a rotation pin 25 mounted between the upper part 21 and the lower part 20 on the first side 23, the rotation pin 25 defining the fourth axis of rotation. As shown in FIG. 2, the rotation pin 25 is coupled to the frame 2, through the lower part 20 of the support 17, at a seat 26 for the rotation pin 25. On the second side 24, the support 17 is associated with the switching element 18, as is described in more detail below.

In the embodiment illustrated, the shifting of the support 17 between the operating position and the insertion position occurs by rotation of the support 17 about the rotation pin 25. However, several types of support 17 movement are possible, for example translations and/or rotations of different types, not illustrated herein.

In the preferred embodiment, the contact roller 16 is advantageously associated with the support 17, between the upper part 21 and the lower part 20, in an intermediate position between the first side 23 and the second side 24. In that way the support 17 can be rotated, about the first side 23 and in particular about the rotation pin 25, between the insertion position in which the contact roller 16 is slightly distanced from the motor-driven roller 11, for allowing insertion of the web between them, and the operating position in which the contact roller 16 is pressed against the motor-driven roller 11.

Figure 10:
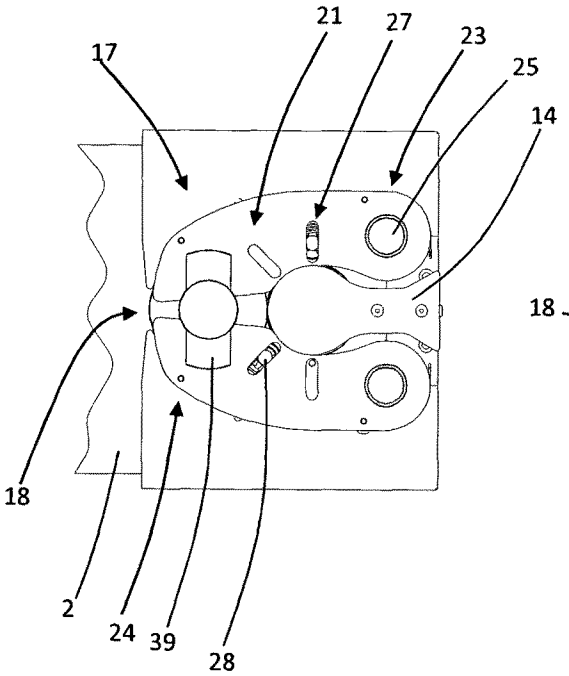
FIG. 10 is a top view of the movement means of FIG. 6.
Figure 15:
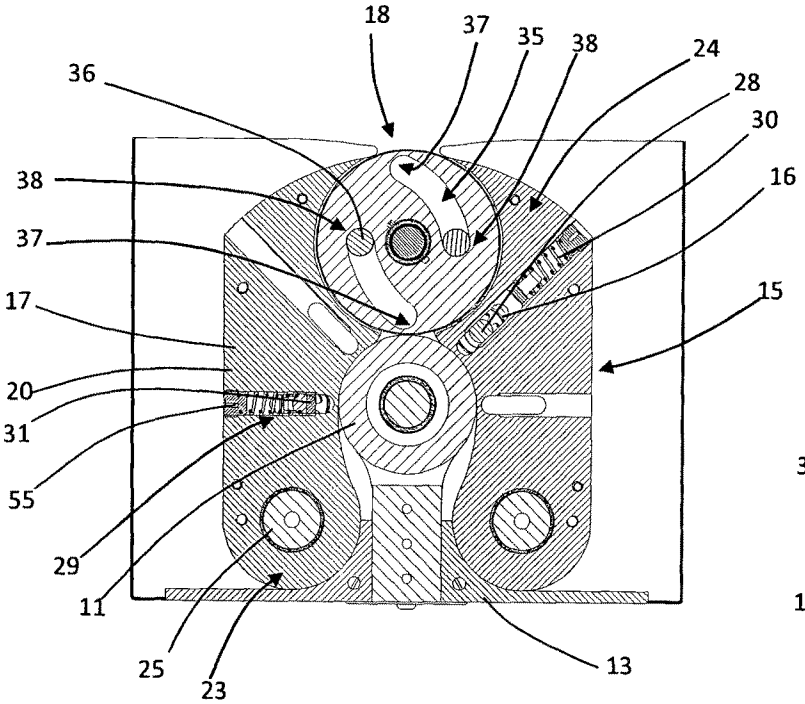
FIG. 15 is a horizontal cross-section of the movement means of FIG. 6, according to the line XV-XV of FIG. 13.

Advantageously, each contact roller 16 is associated with the support 17 by elastic means 27 which push the contact roller 16 against the motor-driven roller 11 when the support 17 is in the operating position. In particular, as shown in FIGS. 10 and 15, each contact roller 16 is equipped with a central pin 28 about which, or at which, the contact roller 16 shell can rotate. In the embodiment illustrated, the central pin 28 of the contact roller 16 is connected at its ends, between the upper part 21 and the lower part 20 of the support 17, at sliding seats 29 present in the lower part 20 and the upper part 21 (FIG. 2). The sliding seats 29 are substantially through holes, made in the lower part 20 and the upper part 21, substantially having the shape of a slot, in such a way that they act as a guide for the movement of the central pin 28 (in particular for its ends) under the action of the elastic means 27 acting on it.

In the preferred embodiment illustrated, as shown in FIGS. 10 to 12 and 15 to 18, the elastic means 27 are advantageously springs 30. In particular, the elastic means 27 act on a guide element 31 connected to one end of the central pin 28 and which can slide in the sliding seat 29. The guide element 31 is in fact associated with the support 17 by means of a spring 30 which pushes the contact roller 16 towards the motor-driven roller 11. There is also a plug 55 present which allows the spring 30 to be compressed. By acting on the plug 55 (for example with a wrench) it is possible to adjust the force applied by the contact roller 16 against the motor-driven roller 11. Adjusting that force adjusts the precision of motion transmission from the motor-driven roller 11 to the web. In the first configuration adopted by the switching element 18 and the support 17, that is to say, with the support 17 in the operating position, the spring 30 will be compressed and will keep the contact roller 16 pressed against the motor-driven roller 11 (situation not illustrated).

Figure 9:
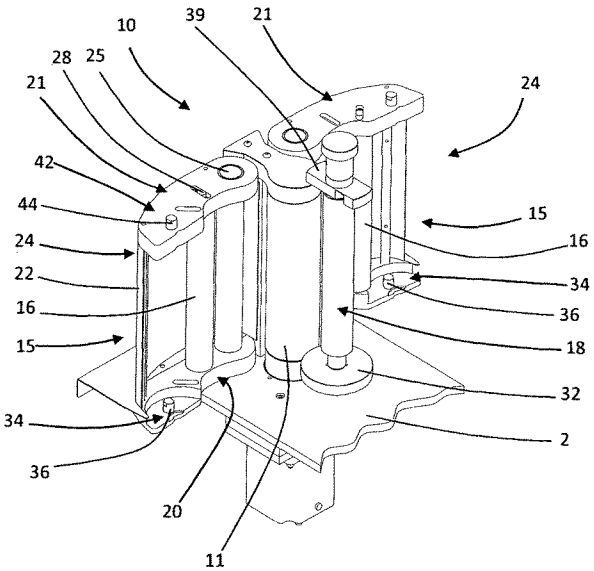
FIG. 9 shows the movement means of FIG. 6 in a fourth configuration.
Figure 12:
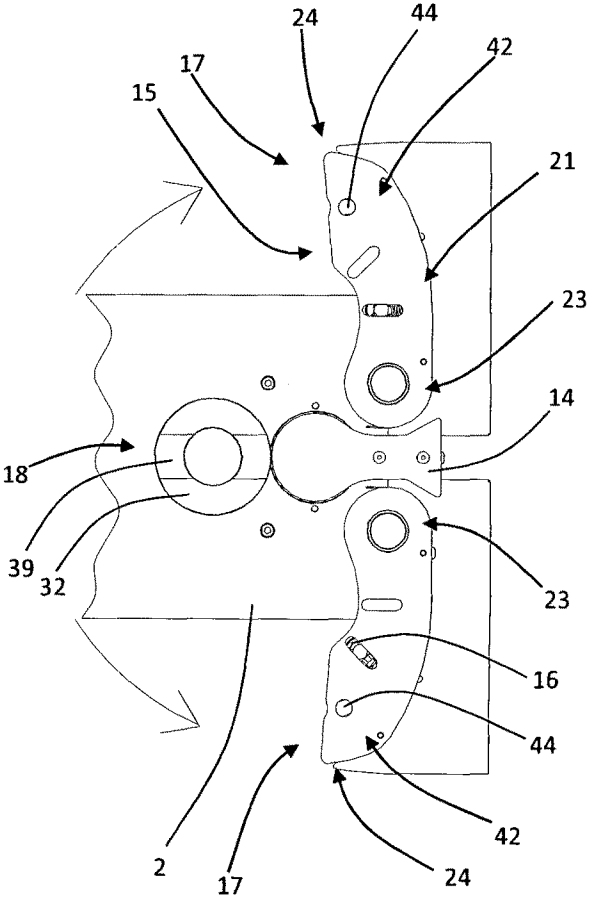
FIG. 12 is a top view of the movement means of FIG. 9.

As already indicated, the switching element 18 and the support 17 may adopt a first configuration, with the support 17 in the operating position (FIGS. 6, 10 and 15), and a second configuration, with the support 17 in the insertion position (FIGS. 7, 11, 13 and 16). Moreover, the switching element 18 and the support 17 may also adopt a third reciprocal configuration (FIGS. 8, 9, 11, 12, 17 and 18) in which the support 17 is also movable at least between the insertion position and a maintenance position in which the contact roller 16 is further from the motor-driven roller 11 than when the support 17 is in the insertion position (FIGS. 9, 12 and 18). Advantageously, in the preferred embodiment, in the maintenance position the support 17 (or both of the supports 17 if, as described below, there are two pressure units 15) is rotated about the rotation pin 25 through approximately 90° compared with when it was in the insertion position (FIGS. 9 and 12). Also according to the preferred embodiment, in the third configuration the support 17 can be idly rotated between the insertion position and the maintenance position.

Figure 8:
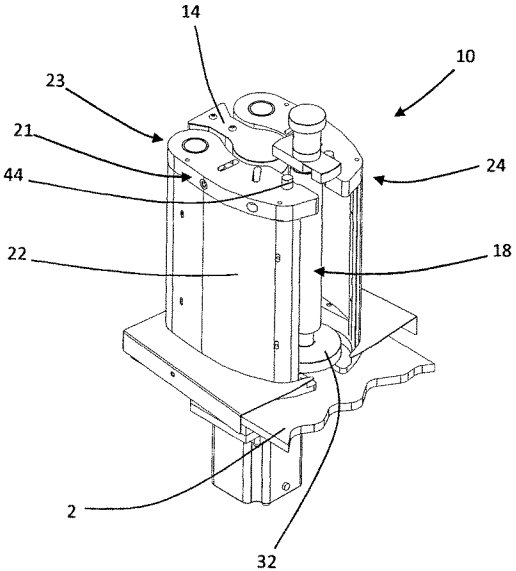
FIG. 8 shows the movement means of FIG. 6 in a third configuration.
Figure 11:
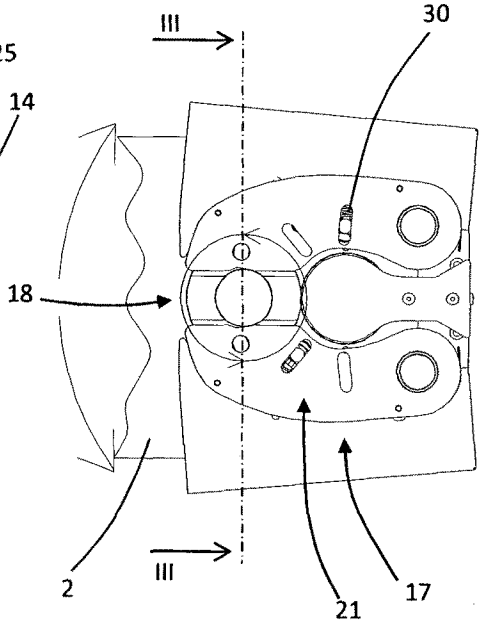
FIG. 11 is a top view of the movement means of FIGS. 7 and 8.
Figure 17:
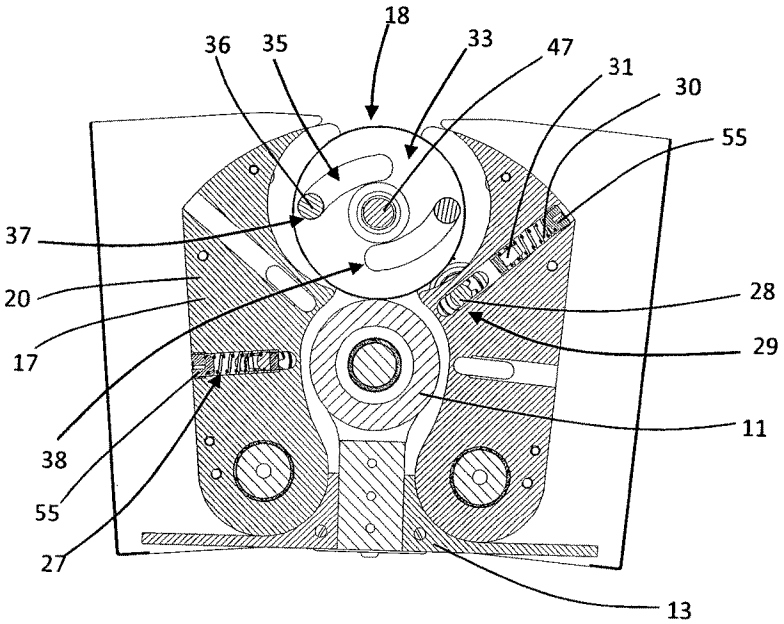
FIG. 17 is a horizontal cross-section of the movement means of FIG. 8, according to the line XV-XV of FIG. 13.
Figure 18:
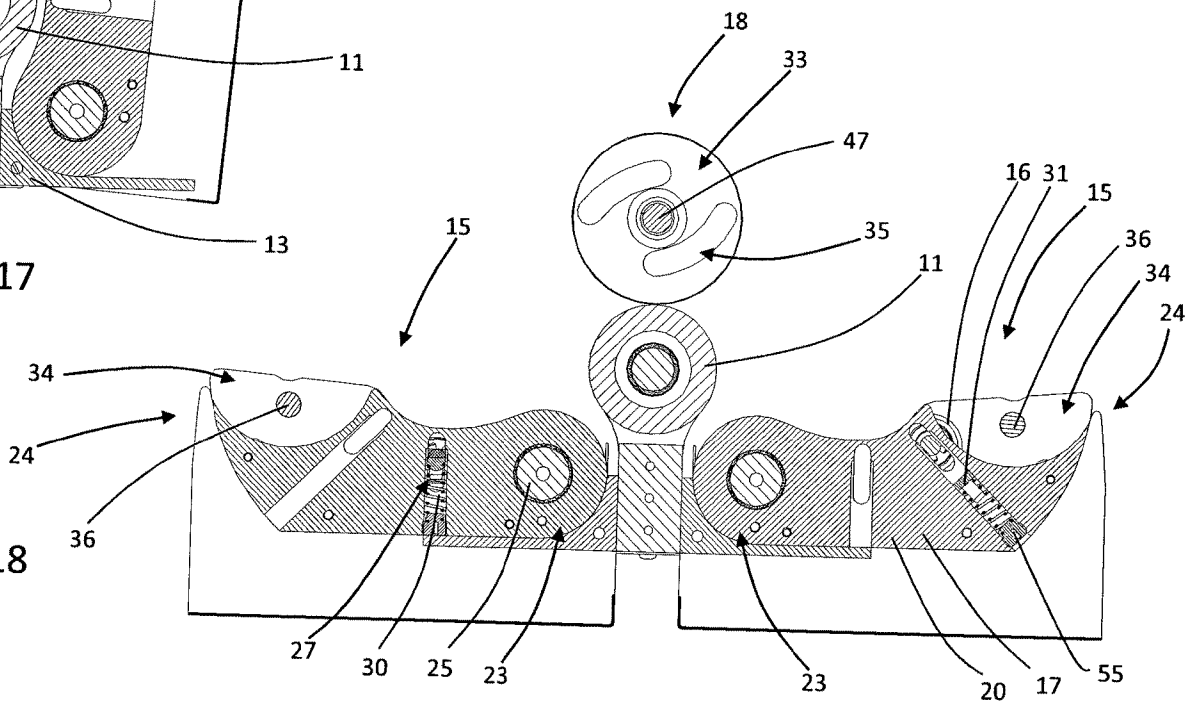
FIG. 18 is a horizontal cross-section of the movement means of FIG. 9, according to the line XV-XV of FIG. 13.

Advantageously, in the preferred embodiment, the switching element 18 can be uncoupled from the support 17 and, in particular, in the third configuration the switching element 18 is uncoupled from the support 17 (FIGS. 8, 11 and 17). Uncoupling of the switching element 18 from the support 17 allows the support 17 to adopt the maintenance position. In the case in question the switching element 18, when coupled to the support 17, allows the support 17 to be shifted between the operating position and the insertion position as previously described and as covered in more detail below. Therefore, advantageously, in the first configuration and the second configuration the switching element 18 is coupled to the support 17. In the preferred embodiment, advantageously, when the support 17 is in the insertion position, the switching 18 can be moved in such a way as to allow the support 17 to adopt the maintenance position. In fact, advantageously the switching element 18 can be uncoupled from the support 17 when they are in the second configuration.

Therefore, in the preferred embodiment, when the support 17 and the switching element 18 are in the second configuration, the switching element 18 can be uncoupled from the support 17 to obtain the third configuration, thus allowing the support 17 to be moved, advantageously idly, between the insertion position and the maintenance position.

In the preferred embodiment illustrated in the accompanying drawings, the movement means 10 advantageously comprise two similar pressure units 15 each positioned on the opposite side of the motor-driven roller 11 to the other. In the accompanying drawings the two pressure units 15 are positioned substantially symmetrically relative to the longitudinal plane comprising the first axis of rotation and the third axis of rotation 19. In any case, the two pressure units 15 illustrated in the accompanying drawings differ substantially because of the different positioning of the respective contact roller 16 and the respective elastic means 27, as shown in FIG. 9 and in FIGS. 15 to 18. The two contact rollers 16 present in the accompanying drawings are pressed, by the respective elastic means 27, in a way that is asymmetrical relative to the longitudinal plane. In fact, observing for example FIG. 15, it can be seen how the pressure unit 15 on the right supports the contact roller 16 in a position closer to the switching element 18, when the support 17 is in the operating or insertion position, compared with the pressure unit 15 on the left, whose contact roller 16 is substantially pressed against the motor-driven roller 11 along a line substantially perpendicular to the longitudinal plane. In the embodiment illustrated, the presence of the two pressure units 15 derives from the fact that the motor-driven roller 11 causes both feeding of the web with the labels towards the detaching station 5, and feeding of the web without labels the opposite way, towards the recovery means 6 (substantially in the known way). Basically, the same amount of web fed to the detaching station 5 is simultaneously removed from it. In particular, the web passes first between the motor-driven roller 11 and the left-hand pressure unit 15, with reference to FIG. 3, and then between the motor-driven roller 11 and the right-hand pressure unit 15.

It should be noticed that what was said with reference to the embodiment comprising a single pressure unit 15 also applies if the device 1 comprises two pressure units 15. In particular, the rotation of each support 17 following the passage from the insertion position to the operating position involves movement of the second side 24 of each of them towards each other. Moreover, advantageously, the switching element 18 is associated with the support 17 of each pressure unit 15 and causes, when switching between the first configuration and the second configuration (which can be adopted by each support 17 together with the switching element 18) and advantageously following its own rotation, the substantially simultaneous passage of the support 17 of each pressure unit 15 between the respective operating position and insertion position. Moreover, the switching element 18 allows the support 17 of each pressure unit 15 to adopt the maintenance position, in the third configuration, following the preferably simultaneous uncoupling from the support 17 of each pressure unit 15.

Therefore, it shall be understood that the first, second and third configurations can be adopted by each support 17 present jointly with the switching element 18, and advantageously they may be adopted simultaneously by each support 17 with the switching element 18.

Hereinafter reference is made to the embodiment comprising two pressure units 15 and what is said with reference to that embodiment is also valid, where applicable, in the case in which the movement means 10 comprise a single pressure unit 15.

Returning to a more detailed description of the switching element 18, in the embodiment illustrated it advantageously has an elongate shape along the line defined by the third axis of rotation 19 and its length is just greater than the distance between the upper part 21 and the lower part 20 of the support 17.

Figure 5:
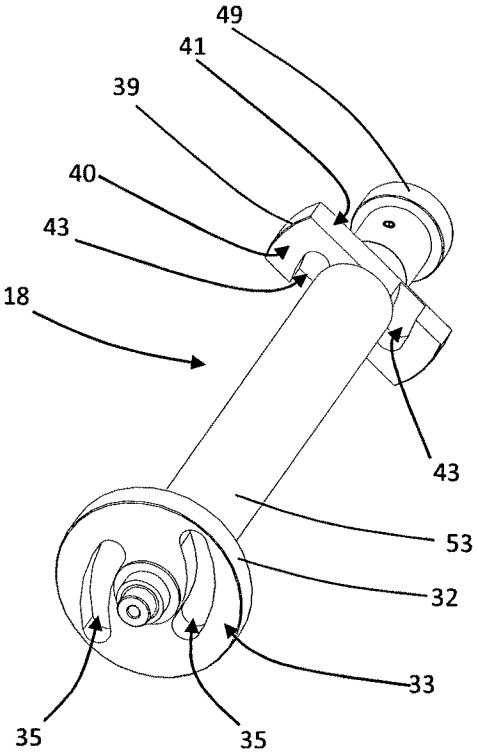
FIG. 5 is an axonometric bottom view of a switching element visible in FIG. 2.

In the preferred embodiment the switching element 18 comprises a lower connecting element 32 comprising its own first coupling face 33 (FIG. 5). In particular, the lower connecting element 32 substantially has the shape of a disk, its first coupling face 33 being on the side designed to make contact with the support 17 (or with the supports 17, if there are two pressure units 15), that is to say, the lower side in the accompanying drawings. Advantageously, each support 17 comprises a second coupling face 34. In the embodiment illustrated the second coupling face 34 is in particular positioned, for each support 17, on the lower part 20 on the second side 24. Coupling between the switching element 18 and each support 17 present advantageously occurs at said coupling faces 33, 34. In more detail, the first coupling face 33 and the second coupling face 34 are substantially facing each other when the switching element 18 and the support 17 are in the first configuration or the second configuration, although said faces during switching between the first and second configurations shift relative to each other due to the shifting of the second side 24 of the support 17.

Moreover, advantageously, in the first coupling face 33 or in the second coupling face 34 there is at least one shaped first seat 35, and respectively on the second coupling face 34 or on the first coupling face 33 there is at least one first locking pin 36 which can be slidably coupled with the shaped first seat 35. In the preferred embodiment, in particular, the shaped first seat 35 is made in the first coupling face 33, therefore it is part of the switching element 18, while the first locking pin 36 is mounted on the second coupling face 34, and is therefore fixed to the support 17. In the embodiment in which there are two supports 17 present, the switching element 18 comprises, at the first coupling face 33, two shaped first seats 35 (or two first locking pins 36), one for each first locking pin 36 (or respectively one for each shaped first seat 35) present on the second coupling face 34 of each support 17 present.

Various types of coupling between the shaped first seat 35 and the first locking pin 36 are possible. Advantageously, the first coupling face 33 and the second coupling face 34 are substantially flat and comprise the first locking pin 36 or the shaped first seat 35 respectively projecting or recessed. In the preferred embodiment the shaped first seats 35 present in the first coupling face 33 are recessed in the volume of the lower connecting element 32 of the switching element 18. Said shaped first seats 35 are therefore configured as grooves. The shaped first seats 35 in particular have an elongate shape and act as a housing for the first locking pins 36. In the preferred embodiment, the sliding between the first locking pin 36 and the shaped first seat 35, following rotation of the switching element 18, causes movement of the support or supports 17 between the operating position and the insertion position. In fact, the movement of the shaped first seats 35 causes shifting of each first locking pin 36 along a trajectory which moves the first locking pin 36 away from the third axis of rotation 19 as the support 17 passes from the operating position to the insertion position, and vice versa during the opposite passage. In the case of the preferred embodiment in which there are two supports 17 present, the trajectories take the first locking pins 36 away from each other as the supports 17 pass from the operating position to the insertion position, and vice versa during the opposite passage. Advantageously, the shaped first seats 35 are shaped in such a way that the respective trajectories of each first locking pin 36 are substantially symmetrical relative to the longitudinal plane.

In the preferred embodiment, each of the shaped first seats 35, seen from below as is evident in FIGS. 15 to 18, substantially has a curved shape. In particular, each shaped first seat 35 is cam-shaped so as to define a movement path for the first locking pin 36 which extends eccentrically relative to the third axis of rotation 19 on the first coupling face 33. In particular, each shaped first seat 35 is a groove extending, transversally to a radial line, between a first end 37 defined on the coupling surface in a first position, and a second end 38, defined in a second position which is radially closer to the third axis of rotation 19.

Therefore, in the embodiment illustrated there is relative sliding between the first locking pin 36 and the shaped first seat 35 which acts as a cam. Advantageously, each shaped first seat 35 forms two end of stroke stops for the related first locking pin 36 for limiting at them the relative shifting between the shaped first seat 35 and the first locking pin 36.

In the preferred embodiment illustrated, in particular, the first end 37 and the second end 38 of the shaped first seat 35 respectively form the first end of stroke stop and the second end of stroke stop for the first locking pin 36. Advantageously, in the preferred embodiment illustrated, each first locking pin 36 rests against the respective second end of stroke stop, when the related support 17 (in the operating position) and the switching element 18 are in the first configuration (FIG. 15), while it rests against the respective first end of stroke stop when the related support 17 (in the insertion position) and the switching element 18 are in the second configuration (FIG. 16).

As already indicated, in the preferred embodiment rotation of the switching element 18 causes switching of the support 17 and the switching element 18 itself between the first configuration (FIG. 6) and the second configuration (FIG. 7). Advantageously, rotation of the switching element 18 is limited by the first end of stroke stop, in the second configuration, when the rotation occurs in a first direction of rotation, and it is limited by a second end of stroke stop, in the first configuration, when the rotation occurs in a second direction of rotation (opposite to the first).

Figure 16:
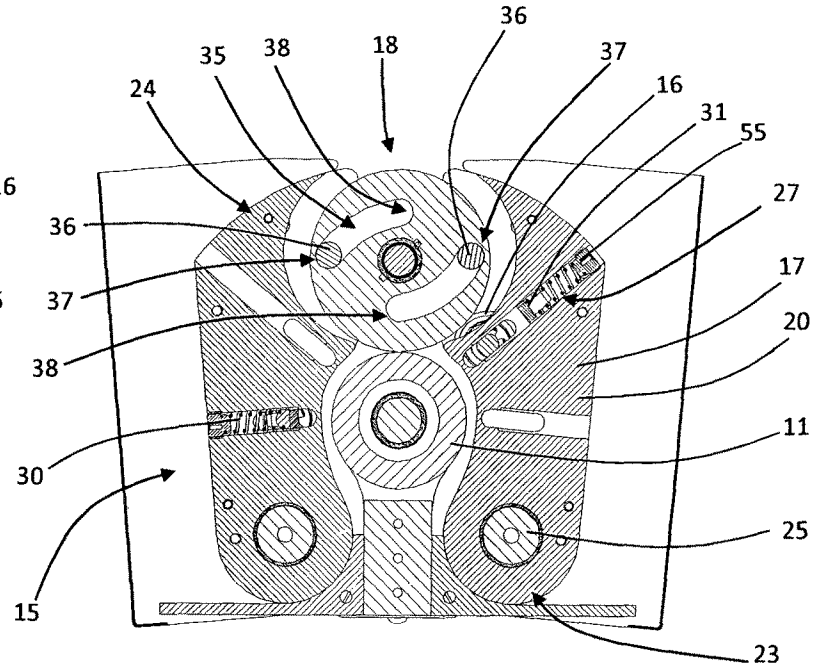
FIG. 16 is a horizontal cross-section of the movement means of FIG. 7, according to the line XV-XV of FIG. 13.

In particular, rotation of the switching element 18 about the third axis of rotation 19 in the first direction of rotation (shown by the arrows in FIG. 11, therefore, anti-clockwise), when the switching element 18 and the support 17 are in the first configuration (with the locking pins against the respective second end of stroke stops), causes switching from the first configuration (FIGS. 10 and 15) to the second configuration (FIGS. 11 and 16). It should be noticed that during the passage from FIG. 15 to FIG. 16, the first coupling face 33 was rotated about the third axis of rotation 19 in a clockwise direction. As FIG. 16 shows, the rotation continues until impact of the first locking pins 36 with the respective first end of stroke stops. In the same way, rotation of the switching element 18 in a second direction of rotation opposite to the first (opposite to that indicated by the arrows in FIG. 11), when the switching element 18 and the support 17 are in the second configuration (and therefore with the locking pins against the first end of stroke stops), causes switching from the second configuration to the first configuration. Again in this case, rotation continues until impact of the first locking pins 36 with the respective second end of stroke stops.

Figure 3:
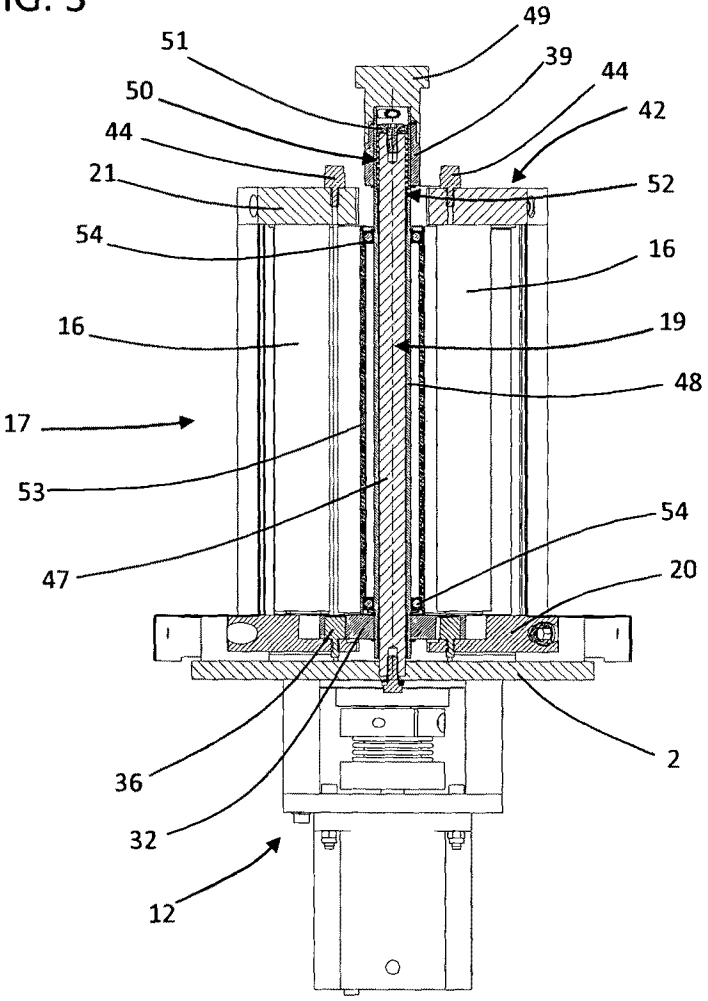
FIG. 3 is a vertical cross-section of the movement means passing through a switching element, according to the line III-III of FIG. 11.
Figure 14:
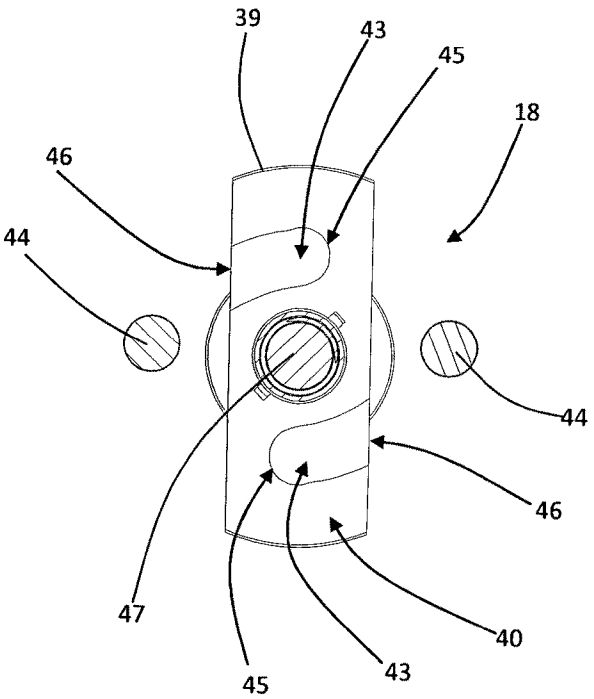
FIG. 14 is a horizontal cross-section of the movement means of FIG. 13, according to the line XIV-XIV.

To guarantee improved clamping of the pressure units 15 on the motor-driven roller 11, the switching element 18 also comprises an upper connecting element 39 comprising its own third coupling face 40 (FIG. 5). The upper connecting element 39 is advantageously similar to the lower connecting element 32. The difference is that, seen in plan view, it appears as a circle without two specular circular segments. In the embodiment illustrated, as shown in FIGS. 5 and 14, the upper connecting element 39 substantially looks like the lower connecting element 32 but cut at two cutting planes substantially parallel with the longitudinal plane when the switching element 18 is in the second configuration. The upper connecting element 39 therefore comprises two lateral faces 41 located at the cutting planes. In that way, when each support 17 and the switching element 18 are in the second configuration, that is to say, when each support 17 is in the insertion position, between the upper connecting element 39 and each support 17, a slit is created through which the web, during positioning along the running path, can be inserted (and removed) between the support 17 and the switching element 18 along a line substantially parallel with the third axis of rotation 19 (FIG. 11). In the second configuration, thanks to the particular shape of the upper connecting element 39, it is in fact possible to insert the web from above between the motor-driven roller 11 and each pressure unit 15. During that operation the web is passed substantially at each lateral face 41 and is then made to descend in the space between a pressure unit 15 and the switching element 18 (FIG. 3).

Each support 17 comprises a fourth coupling face 42. As shown in the accompanying drawings, this fourth coupling face 42 is in particular positioned, for each support 17, on the upper part 21 on the second side 24. Coupling between the switching element 18 and the support 17 therefore also occurs at the third coupling face 40 and the fourth coupling face 42. The third coupling face 40 and the fourth coupling face 42 are substantially facing each other when the switching element 18 and the support 17 are in the first configuration. During switching from the first configuration to the second configuration the third coupling face 40 and the fourth coupling face 42 shift relative to one another until they are no longer substantially facing each other (if seen along a line parallel with the third axis of rotation 19) in the second configuration. Relative shifting between the third coupling face 40 and the fourth coupling face 42 is caused both by rotation of the switching element 18 about the third axis of rotation 19, and by the accompanying shifting of the second ends of the supports 17.

In the third coupling face 40 or in the fourth coupling face 42 there is also at least one shaped second seat 43, and respectively mounted on the fourth coupling face 42 or on the third coupling face 40 there is at one least second locking pin 44 which can be slidably coupled with the shaped second seat 43. In the preferred embodiment, in particular, the shaped second seat 43 is made in the third coupling face 40, therefore it is part of the upper connecting element 39, while the second locking pin 44 is positioned on the fourth coupling face 42, and is therefore fixed to the support 17. In the embodiment in which there are two supports 17 present, the switching element 18 comprises, at the third coupling face 40 (that is to say, on the upper connecting element 39) two shaped second seats 43 (or two second locking pins 44), one for each second locking pin 44 (or respectively one for each shaped second seat 43) present on the fourth coupling face 42 of each support 17.

Various types of coupling between the shaped second seat 43 and the second locking pin 44 are possible. Advantageously, the third coupling face 40 and the fourth coupling face 42, similarly to the first face 33 and the second face 34, are substantially flat and comprise the second locking pin 44 or the shaped second seat 43 respectively projecting or recessed. In the preferred embodiment the shaped second seats 43 present in the third coupling face 40 are recessed in the volume of the upper connecting element 39. The shaped second seats 43 are also therefore configured as grooves and in particular have an elongate shape. Basically, the shaped second seats 43 correspond to the shaped first seats 35 without the portions located at the above-mentioned removed circular segments.

In the preferred embodiment, each of the shaped second seats 43, seen from below as in FIG. 14, substantially has a curved shape and is cam-shaped so as to form a movement path for the second locking pin 44 extending eccentrically relative to the third axis of rotation 19 on the first coupling surface, and at least partly corresponding to that formed by the shaped first seat 35 relative to the same support 17. As already indicated, the shaped second seat 43 is in the form of a groove which extends, transversally to a radial line, between a third end 45 located on the coupling surface in a position which is advantageously aligned, according to a line parallel with the third axis of rotation 19, with the second end 38 of the corresponding shaped first seat 35, and an opening 46, formed in a radially more outer position (along the movement path) advantageously at a lateral face 41.

Therefore, in the embodiment illustrated there is relative sliding between the second locking pin 44 and the shaped second seat 43 which acts as a cam. The sliding is limited between the third end 45 and the opening 46. In particular the third end 45 acts as a third end of stroke stop for the second locking pin 44, for limiting rotation of the switching element 18 in the first configuration, when it is rotating in the second direction of rotation. In contrast, at the opening 46 the second locking pin 44 may uncouple from the shaped second seat 43 following rotation of the switching element 18 in the first direction of rotation.

Advantageously, in the preferred embodiment sliding between the secondo locking pin 44 and the shaped second seat 43, following rotation of the switching element 18, causes movement of the support or supports 17 between the operating position and the insertion position only partly, that is to say, only while the second locking pin 44 is inserted in the shaped second seat 43 between the third end of stroke stop and the opening 46. In the same way, the trajectory covered by the second locking pin 44, moving away from the third axis of rotation 19, is only partly determined by the shaped second seat 43. In fact, advantageously, the second locking pins 44 are aligned with the first locking pins 36 along a line parallel with the third axis of rotation 19. Consequently, due to the alignment, the shape of the trajectory of the second locking pin 44 corresponds to that of the first locking pin 36 aligned with it.

Rotation of the switching element 18 in the second direction of rotation, when the support 17 is in the insertion position, causes first coupling of the second locking pin 44 with the shaped second seat 43, advantageously following insertion of the second locking pin 44 in the opening 46, and then sliding of the second locking pin 44 relative to the shaped second seat 43 until the third end of stroke stop (formed by the third end 45) is reached. Said sliding at least partly causes movement of the support 17 from the insertion position to the operating position, in particular when both the first locking pin 36 and the second locking pin 44 are sliding respectively in the shaped first seat 35 and in the shaped second seat 43. In contrast, rotation of the switching element 18 in the first direction of rotation, when the support 17 is in the operating position (that is to say, advantageously, with the second locking pin 44 against the third end of stroke stop), causes first sliding in the opposite direction to the previous direction and at least partly movement of the support 17 from the operating position towards the insertion position, followed by uncoupling of the second locking pin 44 and the shaped second seat 43, at the opening 46.

Substantially the upper connecting element 39 forms with each support 17 present a second coupling point between the support 17 and the switching element 18, a coupling which is advantageously only maintained when the support 17 is in the operating position, not when it is in the insertion position. It should be emphasised how the presence of a second point of contact between the support 17 and the switching element 18, and the presence of the upper connecting element 39 as described above, relate to an inventive concept which can be applied to any device 1 for feeding labels irrespective of whether or not the support 17 can adopt a maintenance position or the support 17 and the switching element 18 can adopt a third reciprocal configuration. Said inventive concept may also be applied irrespective of whether or not the switching element 18 can be uncoupled from the support 17.

Figure 4:
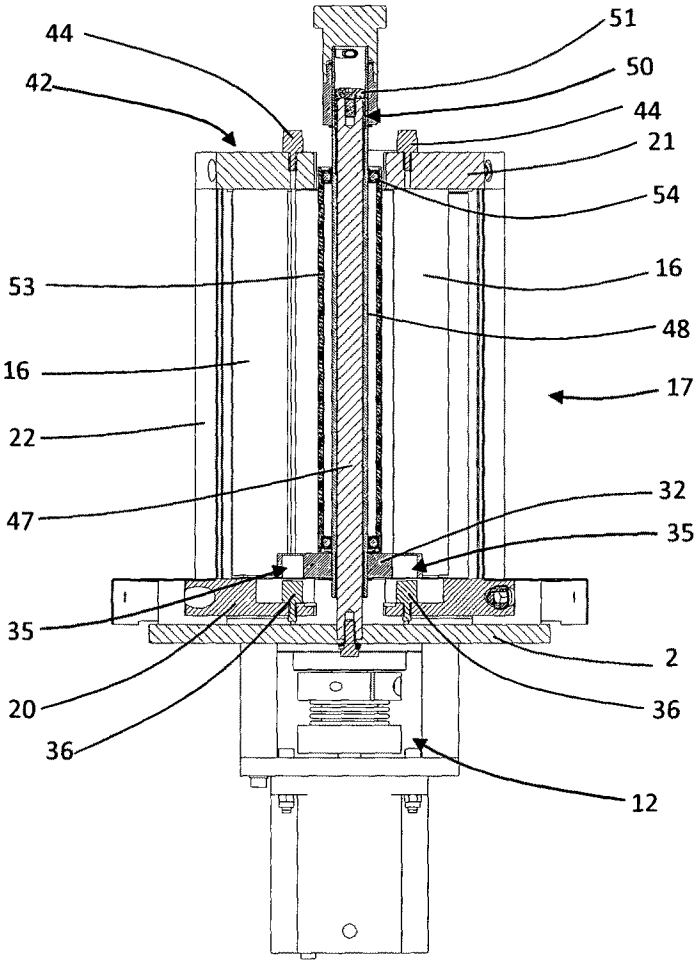
FIG. 4 shows the movement means of FIG. 3 in a different configuration.

Moving on to describe the switching element 18 in more detail, in the embodiment illustrated, as shown in FIGS. 3 and 4, it is advantageously mounted around a rigid pin 47 associated with the frame 2 which defines the third axis of rotation 19. Advantageously, the switching element 18 comprises a cylindrical first element 48 which is hollow and rotatably associated with the rigid pin 47 which is in turn inserted in the cylindrical first element 48. Mounted on the cylindrical first element 48, at the top, there is the upper connecting element 39 and, at the bottom, the lower connecting element 32, which are fixed to it. Substantially, mounted on the top end of the cylindrical first element 48 there is advantageously a knob 49, for allowing an operator to control the switching element 18.

As already indicated, the switching element 18 can advantageously be uncoupled from the support or supports 17. Even more advantageously, in that case, it can be translated along a line parallel with the first axis of rotation for coupling with and/or uncoupling from the support 17 (or both supports 17). Advantageously, the line along which it can be translated coincides with the third axis of rotation 19. In the preferred embodiment the uncoupling involves the cylindrical first element 48. In fact, advantageously, the cylindrical first element 48 can slide on the rigid pin 47 along the line identified by the third axis of rotation 19.

Positioned between the cylindrical first element 48 and the rigid pin 47 there are elastic pushing means for pushing respectively the first coupling face 33 (relative to the lower connecting element 32) towards the second coupling face 34, and the third coupling face 40 (relative to the upper connecting element 39) towards the fourth coupling face 42, when the switching element 18 and the support 17 are in the first configuration. Basically, the pushing means allow the coupling between the switching element 18 and the support or supports 17 to be maintained. The pushing means also allow pushing of the first coupling face 33 towards the second coupling face 34 even when the support or supports 17 and the switching element 18 are in the second configuration. That is not the case for the upper connecting element 39 since in that configuration, in the preferred embodiment, the third coupling face 40 and the fourth coupling face 42 of each support 17 advantageously are not facing each other.

In the embodiment illustrated, in particular with reference to FIGS. 3 and 4, it can be seen how the pushing means substantially comprise a pusher spring 50. The pusher spring 50 is advantageously wound around the rigid pin 47 and the top of the spring makes contact with a head 51 of the rigid pin 47, projecting radially (with reference to the third axis of rotation 19) from the rigid pin 47, while the bottom of the spring makes contact with a sliding bushing 52 which in turn rests on an annular shoulder made in the cylindrical first element 48. FIG. 3 substantially shows the movement means 10 comprising the two pressure units 15, the motor-driven roller 11 and the switching element 18, in which the supports 17 are in the insertion position and the support 17 and the switching element 18 are in the second reciprocal configuration. In that configuration it should be noticed how the pusher spring 50 is not very compressed and has a first extension. As already indicated, the passage from the second configuration to the third configuration is determined by uncoupling of the switching element 18 and the support 17. During switching between the second configuration (FIG. 3) and the third configuration (FIG. 4), the switching element 18 is advantageously lifted. Advantageously the lifting occurs by means of translation of the cylindrical first element 48 along the line defined by the third axis of rotation 19, that is to say, it occurs by removal, advantageously partial, of the cylindrical first element 48 from the rigid pin 47. Lifting of the switching element 18 therefore causes further compression of the pusher spring 50 which, as shown in FIG. 4, in the end has a second extension which is less than the first. The pusher spring 50 therefore not only maintains, during device 1 operation, the coupling between the switching element 18 and the support or supports 17, but also tends to restore that coupling even when the switching element 18 is uncoupled from the support 17, that is to say, when the first locking pin or pins is or are uncoupled from the respective shaped first seat 35 (FIG. 4).

In the embodiment illustrated, around the cylindrical first element 48 there is also a cylindrical second element 53 rotatably associated by running means 54, such as ball bearings. Said running means allow the cylindrical second element 53 to rotate about the third axis of rotation 19 relative to the cylindrical first element 48. In the way, the cylindrical second element 53 forms a return element for the web if the web, during operation, were to accidentally make contact with the switching element 18. In that way, following contact with the web, the switching element 18 would not be an obstacle to web feed. Advantageously, the cylindrical second element 53 allows a reducing in the empty space existing between each pressure unit 15, on the second side 24, and the switching element 18 when the latter and the support 17 are in the operating configuration. In that way, during operation, it is impossible for an operator to accidentally touch the motor-driven roller 11.

In an alternative embodiment not illustrated, to promote partial lifting of the switching element 18, the shaped first seats 35 may advantageously have variable depth. In particular they could have a flat inner surface at a first depth (inside the lower connecting element 32) substantially constant in the stretch between the first end 37 and the second end 38. At the first end 37 they could have a surface angled from the first depth to a second depth which is less than the first so that, starting from the second configuration, following further rotation of the element in the first direction of rotation, the first locking pin 36 slides on the angled surface, pushing the lower connecting element 32 upward to overcome the resistance of the pusher spring 50, therefore causing the third configuration to be reached when the first locking pin 36 reaches the part of the shaped first seat 35 with the second depth.

Similarly, the lateral surface of the lower connecting element 32 could be at least locally angled to facilitate coupling between the lower connecting element 32 and the support 17 when the support 17 is shifted from the maintenance position to the insertion position. In that way, to be able to couple the switching element 18 to the support 17, in the third configuration, each support 17 can be shifted from the maintenance position towards the insertion position. Then, by pushing the support 17 towards the switching element 18 the first locking pin 36 strikes the angled lateral surface of the upper connecting element 39 and begins sliding on it, causing lifting of the lower connecting element 32 and overcoming the resistance of the pusher spring 50, until the first locking pin 36 is in contact with the first coupling face 33 so that it can then be inserted in the respective shaped first seat 35.

The following is a description of device 1 operation in particular with reference to the movement means 10.

As already indicated, the support 17 of each pressure unit 15 is movable between an operating position, an insertion position and a maintenance position. In particular during device 1 operation the support 17 is in the operating position (therefore, the support 17 and the switching element 18 are in the first configuration) in such a way that the contact roller or rollers is or are pressed against the motor-driven roller 11 for clamping the web between them. Therefore, during operation, each contact roller 16 rotates in the opposite direction (advantageously idly or with a slight braking action applied) to the motor-driven roller 11, thus feeding the web with the latter. In the embodiment illustrated the web comprising labels being fed towards the detaching station 5 is moved between the motor-driven roller 11 and the left-hand pressure unit 15, with reference to FIG. 1, while the web without labels being fed from the detaching station 5 towards the recovery means 6 is moved between the motor-driven roller 11 and the right-hand pressure unit 15.

Figure 6:
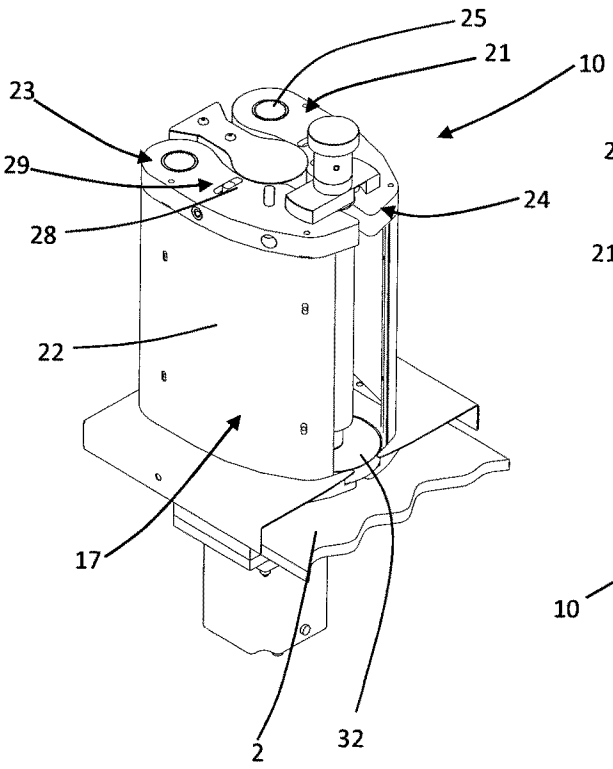
FIG. 6 is an axonometric top view of the movement means of the device of FIG. 1 in a first configuration.

When the reel of the web with labels attached to it runs out, it must be substituted. The switching element 18 is rotated (anti-clockwise seen from above) to simultaneously shift the supports 17, and in particular to cause their rotation about the respective rotation pin 25 passing through the first side 23, from the operating position to the insertion position, therefore reaching the second configuration (FIGS. 7, 11, 13 and 16). Therefore, rotation of the switching element 18 causes shifting of each support 17 and the accompanying uncoupling of each support 17 and the upper connecting element 39. In the second configuration the web can be positioned along the running path around the return means 8 and between each pressure unit 15 and the motor-driven roller 11: when the upper connecting element 39 is present, this in particular is allowed thanks to the special shape of the upper connecting element 39 which allows web insertion from above through the slit created, substantially at the lateral faces 41, between the switching element 18 and each support 17. The switching element 18 is then rotated in the opposite direction to before, for shifting each support 17 into the operating position, therefore again reaching the first configuration (FIGS. 6, 10 and 15).

If, instead, maintenance or cleaning of a pressure unit 15 or the motor-driven roller 11 is required, when the support 17 and the switching element 18 are in the second configuration, the switching element 18 is uncoupled from each support 17 to obtain the third configuration (FIGS. 8, 11 and 17). In particular, the switching element 18, having overcome the resistance of the pusher spring 50, is lifted and partly removed from the rigid pin 47, causing uncoupling of each first locking pin 36 and each shaped first seat 35, as shown in FIG. 4. In this condition each support 17 can be shifted, and in particular rotated about the respective rotation pin 25, between the insertion position and a maintenance position, substantially as required, for allowing improved access to the components of the pressure unit 15 and to the motor-driven roller 11 (FIGS. 9, 12 and 18).

When the maintenance work is complete, each support 17 can be returned to the insertion position and the switching element 18 can again be coupled to each support 17, thus restoring the coupling between each first locking pin 36 and the respective shaped first seat 35. In this situation the pusher spring 50 promotes movement towards each other again of the first coupling face 33 and the second coupling face or faces. Each support 17 and the switching element 18 are therefore again in the second configuration.

This invention brings important advantages.

First, thanks to the face that each support is also movable between the insertion position and a maintenance position in which it is distanced from the motor-driven roller, and also thanks to the fact that the switching element and each support can be switched from the second configuration to the third configuration, the device allows maintenance and cleaning operations to be facilitated, guaranteeing easy access to the inner components of the pressure unit and the motor-driven roller. In fact, switching the support and the switching element to the third reciprocal configuration allows access to the components of the movement means without having to disassemble the movement means. This also considerably speeds up maintenance and cleaning operations. In fact an operator, rather than disassembling (at least partly) the movement means, can simply lift the switching element, causing it to be uncoupled from the supports. Once the maintenance or cleaning is complete, the operator can simply reposition the supports in the insertion position and couple up the switching element to them again.

Second, thanks to the presence of the upper connecting element, the coupling between the switching element and each support occurs at two points and in that way allows a reduction in support vibrations during operation, when the support is in the operating position, that is to say, when the contact roller is pressing against the motor-driven roller. In that way, the presence of the upper connecting element, as well as guaranteeing improved adherence of the contact rollers present with the motor-driven roller, allows a reduction in the operating noise caused by vibrations that are otherwise created in prior art devices in which the switching element makes contact with the support at a single point located at the lower connecting element.

Finally, it should be noticed that this invention is relatively easy to produce and that even the cost linked to implementing the invention is not very high. The invention described above may be modified and adapted in several ways without thereby departing from the scope of the inventive concept.

Moreover, all details of the invention may be substituted with other technically equivalent elements and the materials used, as well as the shapes and dimensions of the various components, may vary according to requirements.

The invention claimed is:

1. A device for feeding self-adhesive or "pressure sensitive" labels to a labelling machine comprising:

a frame (2);

supporting means (3), associated with the frame (2), for a reel of web on which self-adhesive or "pressure sensitive" labels are applied;

a detaching station (5) for detaching the labels from the web, associated with the frame (2);

recovery means (6) for recovering the web, which are associated with the frame (2);

there being a web running path between the supporting means (3), the detaching station (5) and the recovery means (6);

web return means (8), associated with the frame (2) and positioned along the running path;

movement means (10) for moving the web which are associated with the frame (2) for moving the web along the running path, the movement means (10) in turn comprising:

a motor-driven roller (11) associated with the frame (2), the motor-driven roller (11) being able to rotate about a first axis of rotation and move the web by contact with it;

at least one pressure unit (15) for pressing the web against the motor-driven roller (11), the pressure unit (15) comprising:

at least one contact roller (16) which can rotate about a second axis of rotation parallel with the first axis of rotation at least in the opposite direction to the motor-driven roller (11), the contact roller (16) in practice being able to be pressed against the motor-driven roller (11) for clamping the web between it and the motor-driven roller (11); and at least one support (17) for the contact roller (16), the support (17) being associated with the frame (2) and movable relative to it between an operating position, in which the contact roller (16) is pressed against the motor-driven roller (11), and an insertion position in which the contact roller (16) is distanced from the motor-driven roller (11) and allows insertion of the web between them;

the movement means (10) also comprising at least one switching element (18) associated with the support (17) for causing the support (17) to switch at least between the operating position and the insertion position, the switching element (18) and the support (17) being able to adopt a first reciprocal configuration in which the switching element (18) keeps the support (17) in the operating position and a second reciprocal configuration in which the switching element (18) keeps the support (17) in the insertion position; and characterised in that the switching element (18) and the support (17) can also adopt a third reciprocal configuration in which the switching element (18) remains connected with the frame (2) and in which the support (17) is also movable idly at least between the insertion position and a maintenance position in which the contact roller (16) is further from the motor-driven roller (11) than when the support (17) is in the insertion position, the switching element (18) and the support (17) having a different position relative to each other in the second reciprocal configuration and the third reciprocal configuration.

2. The device according to claim 1, characterised in that the switching element (18) can be uncoupled from the support (17), and in that in the third configuration the switching element (18) is uncoupled from the support (17), uncoupling of the switching element (18) from the support (17) allowing the support (17) to adopt the maintenance position.

3. The device according to claim 2, characterised in that in the first configuration and the second configuration the switching element (18) is coupled to the support (17).

4. The device according to claim 2, characterised in that the switching element (18) can be uncoupled from the support (17) when they are in the second configuration.

5. The device according to claim 2, characterised in that the switching element (18) can be translated along a line parallel with the first axis of rotation for coupling with and/or uncoupling from the support (17).

6. The device according to claim 1, characterised in that the switching element (18) is rotatable about a third axis of rotation (19) parallel with the first axis of rotation, the rotation of the switching element (18) causing the switching between the first configuration and the second configuration.

7. The device according to claim 6, characterised in that rotation of the switching element (18) in a first direction of rotation, when the switching element (18) and the support (17) are in the first configuration, causes switching from the first configuration to the second configuration, and rotation of the switching element (18) in a second direction of rotation opposite to the first, when the switching element (18) and the support (17) are in the second configuration, causes switching from the second configuration to the first configuration.

8. The device according to claim 6, characterised in that the switching element (18) comprises a lower connecting element (32) comprising a first coupling face (33), in that the support (17) comprises a second coupling face (34), the coupling between the switching element (18) and the support (17) occurring at the coupling faces, said first coupling face (33) and second coupling face (34) facing each other when the switching element (18) and the support (17) are in the operating or insertion configuration, and in that in the first coupling face (33) or the second coupling face (34) there is at least one shaped first seat (35), and respectively mounted on the second coupling face (34) or on the first coupling face (33) there is at least one first locking pin (36) which can be slidably coupled with the shaped first seat (35), the sliding of the first locking pin (36) in the shaped first seat (35), following rotation of the switching element (18), causing movement of the support (17) between the operating position and the insertion position.

9. The device according to claim 8, characterised in that rotation of the switching element (18) in a first direction of rotation, when the switching element (18) and the support (17) are in the first configuration, causes switching from the first configuration to the second configuration, and rotation of the switching element (18) in a second direction of rotation opposite to the first, when the switching element (18) and the support (17) are in the second configuration, causes switching from the second configuration to the first configuration, and in that the shaped first seat (35) forms two end of stroke stops for the first locking pin (36) for limiting with a first end of stroke stop the rotation of the switching element (18) in the second configuration, when it is rotating in the first direction of rotation, and for limiting with a second end of stroke stop the rotation of the switching element (18) in the first configuration, when it is rotating in the second direction of rotation.

10. The device according to claim 6, characterised in that the switching element (18) comprises an upper connecting element (39) comprising a third coupling face (40), in that the support (17) comprises a fourth coupling face (42), the coupling between the switching element (18) and the support (17) occurring at the third coupling face (40) and the fourth coupling face (42), said third coupling face (40) and fourth coupling face (42) facing each other when the switching element (18) and the support (17) are in the operating configuration, and also being characterised in that in the third coupling face (40) or the fourth coupling face (42) there is at least one shaped second seat (43), and respectively mounted on the fourth coupling face (42) or on the third coupling face (40) there is at least one second locking pin (44) which can be slidably coupled with the shaped second seat (43).

11. The device according to claim 10, characterised in that rotation of the switching element (18) in a first direction of rotation, when the switching element (18) and the support (17) are in the first configuration, causes switching from the first configuration to the second configuration, and rotation of the switching element (18) in a second direction of rotation opposite to the first, when the switching element (18) and the support (17) are in the second configuration, causes switching from the second configuration to the first configuration, and in that rotation of the switching element (18) in the second direction of rotation, when the support (17) is in the insertion position, causes first coupling of the second locking pin (44) with the shaped second seat (43) and then sliding of the second locking pin (44) in the shaped second seat (43), said sliding at least partly causing movement of the support (17) from the insertion position to the operating position, and also in that rotation of the switching element (18) in the first direction of rotation, when the support (17) is in the operating position, first causes sliding in the opposite direction to before, at least partly causing movement of the support (17) from the operating position towards the insertion position, and then uncoupling of the second locking pin (44) and the shaped second seat (43).

12. The device according to claim 11, characterised in that the second shaped seat (43) forms a third end of stroke stop for the second locking pin (44), for limiting at it the rotation of the switching element (18) in the first configuration, when the switching element (18) is rotating in the second direction of rotation.

13. The device according to claim 1, characterised in that the support (17) comprises a first side (23) where it pivots at the frame (2), being able to rotate about a fourth axis of rotation parallel with the first axis of rotation, and a free second side (24) where it is associated with the switching element (18), and in that the contact roller (16) is associated with the support (17) in an intermediate position between the first side (23) and the second side (24).

14. The device according to claim 1, characterised in that said contact roller (16) is associated with the support (17) by elastic means (27), the elastic means (27) pushing the contact roller (16) against the motor-driven roller (11) when the support (17) is in the operating position.

15. The device according to claim 1, characterised in that the movement means (10) comprise two similar pressure units (15), each on the opposite side of the motor-driven roller (11) to the other, the switching element (18) being associated with the support (17) of each pressure unit (15) and causing, when switching between the first configuration and the second configuration, the substantially simultaneous passage of the support (17) of each pressure unit (15) between the operating position and insertion position.

16. The device according to claim 2, characterised in that the movement means (10) comprise two similar pressure units (15), each on the opposite side of the motor-driven roller (11) to the other, the switching element (18) being associated with the support (17) of each pressure unit (15) and causing, when switching between the first configuration and the second configuration, the substantially simultaneous passage of the support (17) of each pressure unit (15) between the operating position and insertion position, and in that the switching element (18) allows the support (17) of each pressure unit (15) to adopt the maintenance position, in the third configuration, following uncoupling from the support (17) of each pressure unit (15).

17. The device according to claim 5, characterised in that the switching element (18) is rotatable about a third axis of rotation (19) parallel with the first axis of rotation, the rotation of the switching element (18) causing the switching between the first configuration and the second configuration, and in that it comprises a rigid pin (47) associated with the frame (2), the rigid pin (47) defining the third axis of rotation (19), and in that the switching element (18) comprises a cylindrical first element (48) rotatably associated around the rigid pin (47), the rigid pin (47) being inserted in the cylindrical first element (48), said cylindrical first element (48) also being uncouplable from the rigid pin (47) by removing it along the line identified by the third axis of rotation (19), there being pushing means between the cylindrical first element (48) and the rigid pin (47) for opposing removal of the cylindrical first element (48).

* * * * *